United States Patent [19]

Rood

[11] 4,434,338

[45] Feb. 28, 1984

[54] COIL SPRING SWITCH

[76] Inventor: Robert M. Rood, 7164 Victoria Rd., St. Paul, Minn. 55119

[21] Appl. No.: 341,605

[22] Filed: Jan. 22, 1982

[51] Int. Cl.[3] ..... H01H 1/06

[52] U.S. Cl. ..... 200/276; 200/164 R; 200/241

[58] Field of Search ..... 200/241, 242, 276, 237, 200/338, 159 A, 164 R

[56] References Cited

U.S. PATENT DOCUMENTS

| | | | |
|---|---|---|---|
| 996,303 | 5/1911 | Wilhelm | 200/159 A |
| 1,333,115 | 3/1920 | Jones | 200/159 R |
| 2,436,123 | 2/1948 | Sines | 200/276 X |
| 3,178,530 | 4/1965 | Lawson | 200/339 |
| 3,207,870 | 9/1965 | Herrera et al. | 200/61.41 |
| 3,396,257 | 8/1968 | Vazquez | 200/276 |
| 3,699,296 | 10/1972 | Harris | 200/67 DB |
| 3,725,625 | 4/1973 | Pratt | 200/159 R |
| 3,731,022 | 5/1973 | Loftus | 200/61.49 |
| 3,745,269 | 7/1973 | Arvai | 200/5 EA |
| 3,773,996 | 11/1973 | Sharf | 200/276 X |
| 3,809,839 | 5/1974 | Beddoe | 200/160 |
| 3,928,736 | 12/1975 | Drage | 200/276 X |
| 3,949,181 | 9/1974 | Kempf | 200/241 X |
| 3,979,571 | 9/1976 | Van Benschoten | 200/276 X |
| 4,016,388 | 4/1977 | Golbeck et al. | 200/159 A X |
| 4,092,503 | 12/1976 | Raeder | 200/276 X |
| 4,169,974 | 10/1979 | Peers-Trevarton | 200/276 |
| 4,209,682 | 6/1980 | Rood | 200/159 R |
| 4,313,685 | 2/1982 | Stahl et al. | 200/276 X |

*Primary Examiner*—Charles E. Phillips
*Assistant Examiner*—Ernest G. Cusick
*Attorney, Agent, or Firm*—Cushman, Darby & Cushman

[57] ABSTRACT

A switch wherein an expanded coil spring is utilized as a first contact and a striker bar having a transverse member disposed in the compression path of coil is utilized as a second contact. Various contact structures and mechanisms for compression spring contact are described.

40 Claims, 6 Drawing Figures

COIL SPRING SWITCH

BACKGROUND OF THE INVENTION

1. Field of the Invention

The present invention relates to apparatus for making or breaking electrical contact in an electrical circuit, and more particularly to a switch contact structure of exceedingly simple construction, suitable for infinite variations of pressure, pre-travel and post-travel distance, and power requirements.

2. Description of the Prior Art

In general, switches wherein one or more electrical contacts are formed of expanded compression (coil) springs are known. For example, U.S. Pat. No. 4,209,682, issued to the present inventor on June 24, 1980, describes a momentary contact switch wherein one contact comprises an expanded compression spring having a transverse contact portion which effects a wiping contact with a conductive striking member when a push button is pressed. The transverse contact portion is flexible, and exerts continuous force against the striking member to provide a low bounce characteristic.

Another switch, which utilizes two concentric expanded compression springs as contacts is described in U.S. Pat. No. 3,773,996, issued to K. A. Sharf on Nov. 20, 1973. One of the springs includes a radial cross bar portion, located at the end or at some intermediate point on the spring, which engages the other spring when the springs are depressed.

U.S. Pat. No. 3,396,257 issued Aug. 6, 1968 to C. Vazquez describes the use of a vertically disposed tightly wound prestressed (compressed) coil spring and a stretched (expanded) coil spring as contacts. The tightly wound coil spring is disposed vertically, with one end fixed on the base of the switch. The expanded coil spring is disposed horizontally, offset from the tightly wound spring. The free end of the tightly wound coil spring is laterally displaced to bring it into electrical contact with the expanded coil spring. The pitch of the expanded coil spring is chosen so that the tightly wound spring makes a wiping contact with two of the coils of the expanded spring.

Other known switches utilize a compression spring as one contact, and a resilient, serpentine shaped metal strip disposed within the spring, as another contact. The serpentine member cooperates with a cammed surface on the interior of a push button, and is deformed (bowed) to effect contact with the spring when the push button is pressed. Such a switch is described in U.S. Pat. No. 3,809,839 issued on May 7, 1974 to S. Beddoe.

Another switch utilizing a compression spring for a contact is described in U.S. Pat. No. 3,699,296, issued to R. H. Harris on Oct. 17, 1972. In such switch a second contact is vertically disposed along one wall of the switch casing. Depression of a push button causes catastrophic buckling, or bowing of the compression spring to effect contact with the vertical member.

Other switches utilize a moving contact cooperating with horizontally disposed spring contacts. Examples of such switches are described in U.S. Pat. No. 3,207,870, issued Sept. 21, 1965 to J. R. Herrera et al and U.S. Pat. No. 3,745,269, issued to T. Arvai on July 10, 1973.

Other springs utilize a push button to cause an expansion of a compressed compression spring to effect wiping action with vertically disposed contacts. An example of such a switch is described in U.S. Pat. No. 1,333,115, issued Mar. 9, 1920 to L. H. Jones.

Other examples of switches utilizing compression spring contacts are described in U.S.. Pat. Nos. 2,436,123, issued Feb. 17, 1948 to E. Sines; 3,731,022, issued May 1, 1973 to T. J. Loftus; and 3,725,625 issued Apr. 3, 1973 to A. R. Pratt.

The prior art coil spring switches, however, tend to be relatively complex in structure, and relatively expensive to manufacture.

SUMMARY OF THE INVENTION

The present invention provides a simple, inexpensive contact structure, which provides extremely low bounce characteristics, and is adaptable to virtually any pressure, pre-travel or post-travel, power, or space requirement. Briefly, an expanded conductive compression spring is disposed for compression along a given axis of compression. A flexible, conductive striking bar is disposed transverse to the axis of compression, preferably tangential to the coil. Compression of the spring causes the spring to make (or break) contact with the rod. The angle of the spring coils provides for a wiping contact. Further, the striking bar is flexed by the contact so that it is biased against the spring coil. The biasing of the striking bar generates a continuous force against the spring coil during the wiping contact, to provide an extremely low bounce characteristic.

Compression of the spring can be effected by pressure along the axis of compression, or by a sideward (lateral) movement of the spring, for example, as caused by a toggle or slide mechanism.

BRIEF DESCRIPTION OF THE DRAWINGS

Preferred exemplary embodiments of the present invention will hereinafter be described in conjunction with the appended drawing, wherein like numerals denote like elements and.

DETAILED DESCRIPTION OF THE PREFERRED EMBODIMENT

Figure 1:
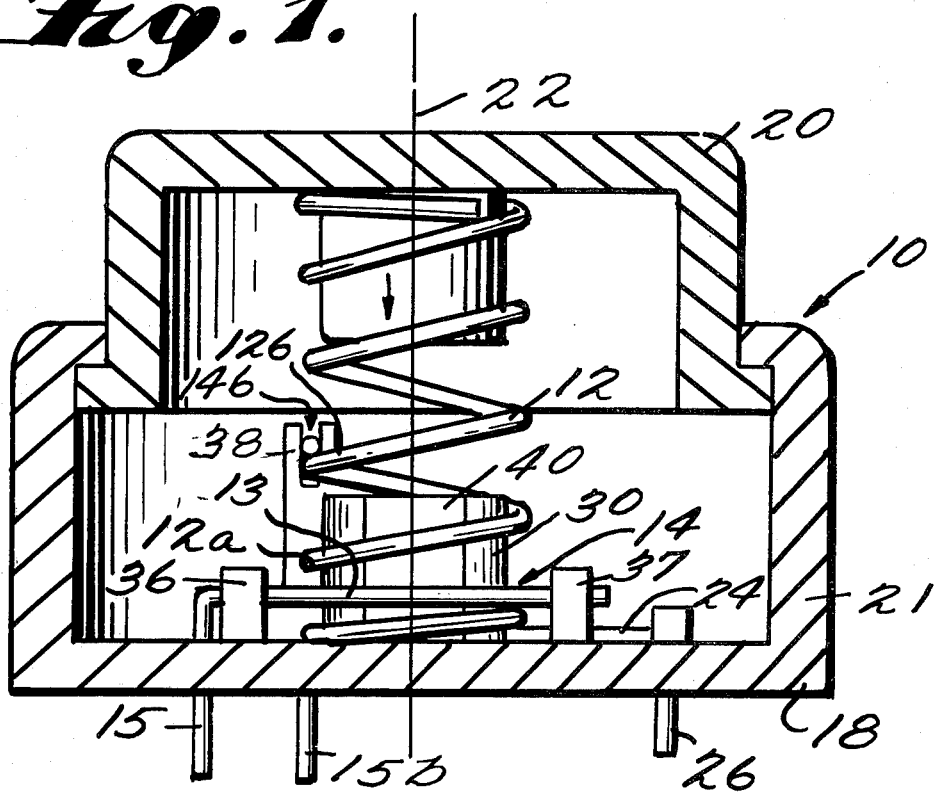
FIG. 1 is a sectional elevation view of a momentary contact switch in accordance with the present invention.
Figure 2:
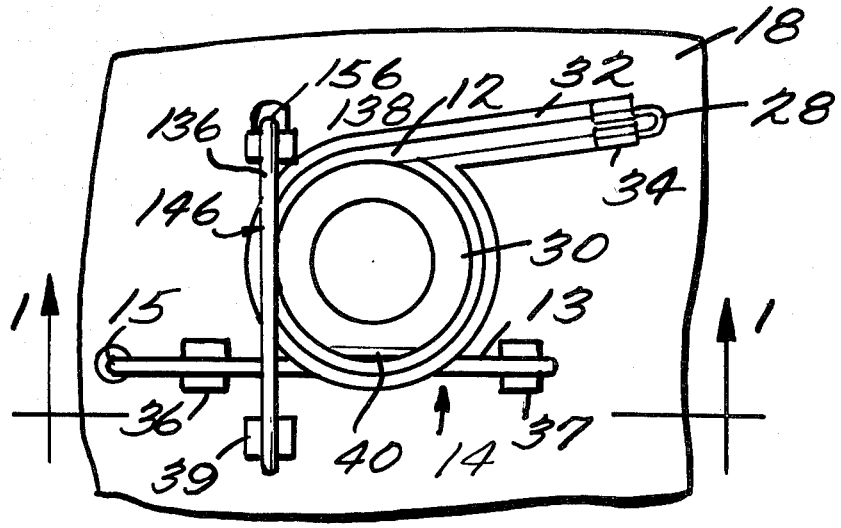
FIG. 2 is a top view of the base and contact structure of the switch of FIG. 1.

Referring now to FIGS. 1 and 2, a switch 10 in accordance with the present invention comprises a conductive spring 12 cooperating with one or more striker bars 14. Spring 12 and striker bars 14 are mounted on a base 18, as will hereinafter be more fully described. Spring 12 also cooperates with a switch cap 20, and is contained in a housing 21.

Spring 12 comprises a generally helical expanded compression spring having at least one coil adapted for compression along an axis of compression, generally indicated as 22. The bottom most coil of spring 12 is bent outwardly to form a bottom extension 24 extending tangentially from the bottom of spring 12. The outer most portion 26 of bottom extension 24 is bent downwardly in a direction generally parallel to the axis of compression.

Spring 12 is disposed on base 18 such that axis of compression 22 is generally normal to base 18. The disposition of spring 12 is maintained by a cylindrical projection 30 and groove 32. Projection 30 has an outer diameter slightly less than the inner diameter of spring 12. Groove 32 is formed in the upper surface of base 18, circumscribing projection 30 and extending tangentially outward to communicate with an aperture 28. Central projection 30 extends into the interior of spring 12, and the bottom most coil and bottom extension of the coil are received in groove 32. Disposing spring 12 in groove 32 permits a reduction in the height of switch 10. Portion 26 of bottom extension 24 extends through an aperture 28 (best seen in FIG. 2) in base 18. Portion 26 of spring 12 is utilized as one of the electrical connectors of switch 10. A fastening device 34, suitably a pair of snap action type projections integrally formed on base 18, is disposed extending over groove 32 to cooperate in securing spring 12 to base 18.

Striker bar 14 suitably comprises a resilient L shaped conductor having a transverse member (13) and a downwardly extending leg (15). Leg 15 extends through an aperture in base 18 and is utilized as an electrical connector for switch 10.

Striker bar 14 is disposed so that transverse member 13 maintained transverse to compression axis 22, and extends between the respective coils of spring 12, i.e. into the compression path of an associated coil 12*a*, and such that flexing in directions parallel to compression axis 22 is permitted. Transverse member can extend into the compression path along any direction transverse to axis 22. For example, transverse member 13 can be disposed to extend radially inward, (or at some other predetermined angle) with respect to spring 12, such that the end of member 13 projects inwardly between respective coils of spring 12. However, it is preferred that tansverse member 13 be disposed along a direction generally tangential to a nominal cylinder concentric with the axis of compression of the associated coil (12*a*) of spring 12, and, in particular with the inner edge thereof tangential to the nominal cylinder defined by inner diameter of the associated spring coil. The tangential disposition is preferred in that wiping action is maximized with a minimum of contact wear.

Respective support members 36 and 37 may be provided, if desired, for striker bar 14. Support members 36 and 37 each comprises an integral projection extending upward from base 18 and includes a slot in the top thereof. Transverse member 13 is received in the slot. The support member slots prevent any longitudial (sidewards) movements by transverse members 13. However, flexing in directions parallel to compression axis 22 is permitted. In addition, a flat cut away 40 is formed in central projection 30 to ensure that projection 30 does not interfere with flexing of member 13.

Spring 12 and striking bar 14 cooperate to provide an extremely low bounce, normally-off momentary contact switch. When push buttom cap 20 is depressed, the respective coils of spring 12 are compressed towards base 18. After cap 20 has been depressed a predetermined pre-travel distance, coil 12*a* of spring 12 comes into contact with striker bar 14 and contact is established. As is well-known in the art, compression of spring 12 causes the pitch of the successive coils of the spring to decrease, effectively changing the specific point on coil 12*a* that comes into contact with striking bar 14. Thus, as the travel continues, a wiping contact is effected between coil 12*a* and transverse member 13 due to the angle (pitch) of coil 12*a*. The wiping engagement is a relatively short distance and therefore cause little contact wear.

The continued deflection also causes a downward flexing of transverse member 13, causing the transverse member 13 to be increasingly biased against coil 12*a*. The biasing of striker bar 14 provides continuous pressure against coil 12*a*, thereby providing an extremely low bounce characteristic. Further, the rebound characteristic of spring 12 ensures a quick break away, and thus low break away resistance, when the push button is released.

Spring 12 and striker bar 14 provide a particularly advantageous momentary contact switch. Switch 10 can readily be adapted to a wide range of applications having varying power, travel length and deflection pressure requirements. The power rating of switch 10 is merely a function of the gauge of spring 12 and striker bar 14. For example, a switch 10 with spring 12 and striker bar 14 of diameters on the order of 0.012 inch are suitable for use in dry circuit applications involving voltages up to approximately 50 volts, whereas switch 10 utilizing spring and striker bars of on the order of 0.02 inch, is suitable for typical 110 volt usages. Similarly, deflection pressure can be varied by altering the stiffness and/or gauge of spring 12. The pre-travel and post-travel distances can be varied by changing the pitch (angle) of spring 12 and the relative disposition of the coils and striker bars.

In a specific example, for dry circuit applications, (voltages up to on the order of 50 volts), spring contact 12 is suitably formed of a 0.012 inch spring metal, 12 coil per inch spring, with coils having an inner diameter of on the order of 0.15 inch. Spring 12 is suitably 0.335 inches in length. Projection 30 suitably extends 0.08 inches above the upper surface of base 18. Channel 32 is suitably 0.015 inches deep and 0.02 inches wide. Striker arm 14 is suitably made of 0.012 inch diameter spring metal and includes a transverse portion on the order of 0.3 inches in length. The foot of striker bar 14 is displaced from coil 12*a* approximately 0.15 inches along the tangent from the center of the coil. Supports 36 and 37 are respectively disposed along the tangent at distances of 0.13 inch (to the outer side), and are of a length of one the order of 0.04 inch). The respective slots are on the order of 0.02 inch wide and 0.085 inch deep. The transverse portion of striker bar 14 is disposed at 0.05 inch from the surface of the base 18, and is displaced downardly from coil 12*a* by a distance equal to approximately two-thirds of the distance between the coils of spring 12. The specific example can be adapted to 110 volt usages by increasing the gauge of striker bar 14 and spring 12 to 0.02 inch.

If desired, switch 10 can be adapted to provide multiple contacts. One or more additional striker bars, such as, for example, striker bar 14*b* would then be included. Supports 38 and 39, equivalent to supports 36 and 37 may also be included. Each striker bar is disposed for contact with spring 12, as described above with respect to striker bar 14. Any relative disposition of the respective striker bars that does not cause mutual interference is suitable. For example, the respective striker bars can be off set in height, and cooperate with different coils of spring 12, or be disposed tangential to different portions of the same (or different) coil, or both.

A specific predetermined operational sequence of multiple contacts can be established by disposing the various contacts at differing distances from the cooperating coils, i.e. that is adjusting the respective pre-travels with respect to the individual striker bars so that contact between one striker bar and spring 12 is effected before contact between a second striker and spring 12, and so forth.

One or more striker bars, such as, for example, striker bar 14*b* can also provide for normally closed operation. Striker bar 14*b* is disposed in the compression path of coil 12*b* of spring 12 so that it is biased against coil 12*b* when spring 12 is in its normally expanded state. Coil 12*b*, when in the expanded position, causes an upward flexing of striker bar 14*b*. As cap 20 is depressed to compress spring 12, coil 12*b* withdraws from striker bar 14*b*. Again, the biasing of striker bar 14*b* and angle of spring 12 cooperate to provide a low bounce, wiping contact.

Figure 3:
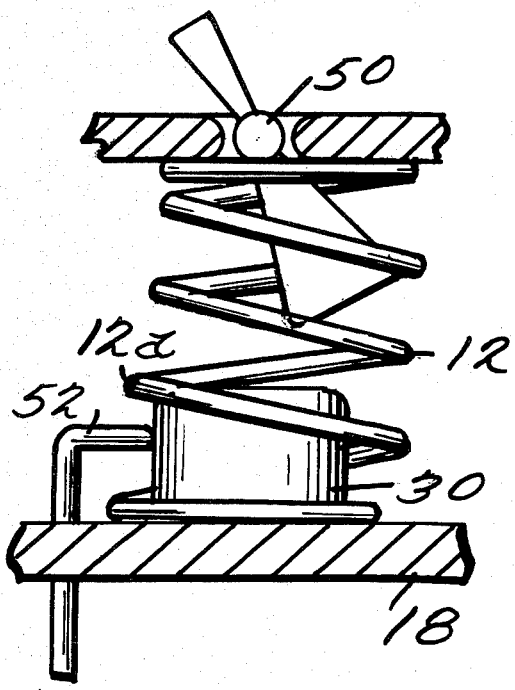
FIGS. 3 and 4 are respective sectional elevation views of a toggle switch in accordance with the present invention.

Compression of spring 12 can be effected in a variety of ways. For example, as previously noted, compression can be effected by depressing a cap associated with spring 12, to exert a force in the direction of the axis of compression, as shown in FIG. 1. Alternatively a single side of spring 12 can be compressed, or, spring 12 can be secured to base 18 about projection 30 as in the case of the momentary contact switch of FIGS. 1 and 2, and a lateral force can be applied to the top of spring 12, to cause a distortion tanamount to compression of one side of the spring. For example, referring to FIGS. 3 and 4, a conventional toggle mechanism, schematically represented as 50 may be utilized to provide such lateral force. In FIG. 3, toggle 50 displaces the top portion of spring 12 to the side opposite a striker bar 52, i.e. to the right. Striker bar 52, as illustrated, includes a transverse member extending outward from the drawing, and includes an L shaped support portion bent 90 degrees from the striker arm portion. The transverse member of striker arm 52 is disposed tangential to coil 12*a* of spring 12 and generally normal to the direction of displacement of spring 12 by toggle 50. If desired, however, the striker arm 52 can be identical to striker arms 14 of FIG. 1. When spring 12 is displaced towards the right, the right side spring 12 is, in effect, compressed in the vicinity of base 18. The left side of spring 12 (nearest striker arm 52) is, in effect, expanded. Striker bar 52 is disposed in predetermined relation with, e.g. isolated from, coil 12*a* when spring 12 is displaced to the right by toggle 50.

Figure 4:
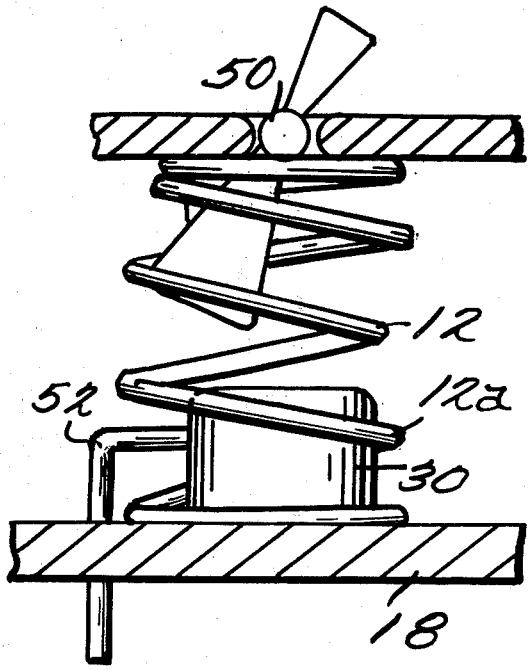

However, when spring 12 is displaced in the direction of striker bar 52, i.e., to the left, as illustrated in FIG. 4, the left side of coil 12*a* is compressed and comes into contact with striker bar 52. Coil 12*a* causes a downward flexing of striker arm 52. Thus, striker arm 52 is biased against coil 12 and provides a continuous pressure against 12*a* during the switching action. The biasing of striker arm 52 and the angle of coil 12*a* cooperate to provide a wiping contact and to substantially reduce or prevent bounce transients during the switching operations. It should be appreciated that a further striker bar can be disposed on the right side of spring 12 to provide single pole, double throw switch operation.

The spring-striker bar contacts of the present invention can be utilized in various other types of switches. For example, cap 20 and housing 21 shown in FIG. 1, can be replaced by a suitable snap action type cap and mechanism, such as described in the aforementioned U.S. Pat. No. 3,773,996, issued to Sharf, or U.S. Pat. No. 3,699,296, issued to Harris.

Figure 5:
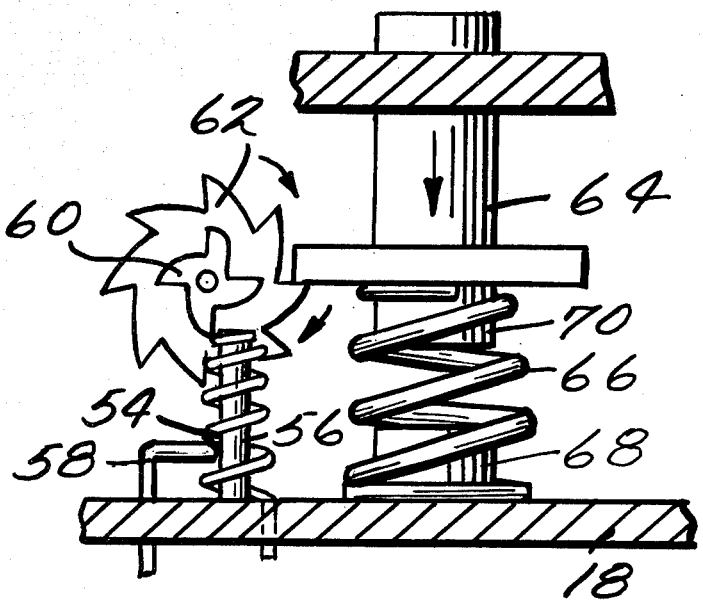
FIG. 5 is a sectional elevation view of a push-push switch in accordance with the present invention.

A push-push switch may also be implemented utilizing the contact arrangement of the present invention. Referring now to FIG. 5, an expanded compression spring contact 54 is disposed about a post 56 projecting from base 18. Spring 54 cooperates with a striker bar contact 58, similar to striker bar 52 of FIGS. 3 and 4. Spring 54 also cooperates with a suitable cam mechanism 60.

Cam mechanism 60 selectively provides a downward force on spring 54 to compress the spring to effect a contact with striker bar 58 (as explained in conjunction with FIG. 1). Post 56 prevents lateral displacement of spring 54 by cam 60.

Cam 60 is rotated by a suitable rachet mechanism 62. Rachet mechanism 62 operates in response to depression of a push button 64. Push button 64 is upwardly biased by an expanded compression spring 66, secured to a projection 68 in base 18 and a corresponding projection 70 on push button 64. When push button 64 is depressed, rachet mechanism 62 is advanced an increment. Cam 60 is in turn advanced by one increment to either compress or release spring 54.

In some instances, placement of the striker bar can be facilitated by providing one or more outsized coils in the coil spring contact. An example of a switch utilizing such outsized coils is shown in FIG. 6.

Figure 6:
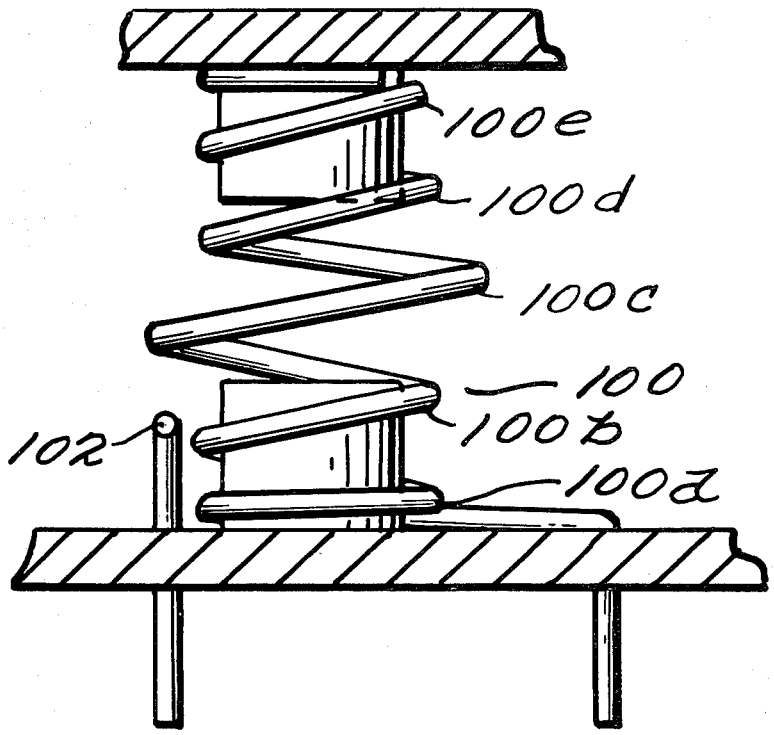
FIG. 6 is a sectional elevation view of a momentary contact switch in accordance with the present invention utilizing an outsized coil.

Referring to FIG. 6, a coil 100, including respective coils 100*a*, 100*b*, 100*c*, 100*d* and 100*e*, is substituted for coil 12 of the embodiment shown in FIG. 1. The majority (100*a*, 100*b*, 100*d*, 100*e*) of the coils of spring 100 are of a first diameter (e.g. 0.0125), however, one or more outsized coils (100*c*) of a greater diameter (e.g. 0.0187), are suitably included within the middle third of spring 12. Outsized coil 100*c* suitably exceeds the diameter of the majority of the coils by on the order of one wire diameter, so that outsized coil 100*c* in effect forms a "ledge" about spring 100, when spring 100 is compressed. A striker bar 102 is disposed in the compression path of coil 100*c* to selectively effect a wiping contact, in the manner previously described. The transverse member of striker bar 102 can be disposed, if desired, adjacent to, and only slightly above the coil (100*b*) adjacent to coil 100*c*. Thus, the use of an outsized coil in spring 100 is particularly advantageous in a situation where it is desirable to use a spring 100 having intercoil spacing (pitch) that is not sufficient to accommodate the striker bar transverse member and still provide a desired pretravel distance. In other words, the use of outsized coil 100*c* permits a reduction in switch height for a given desired pretravel distance.

It should be appreciated that the present invention provides a switch contact structure of extremely simple and inexpensive construction. When used in a momentary contact switch, the contact structure can be adapted to provide an infinitely variable pressure characteristics, by varying the stiffness and pitch of spring 12. Similarly, an exceedingly wide range of pre-travel and post-travel distance requirements can be accomodated, by varying the spacing of the coils, i.e. pitch of spring 12. In addition, the contact mechanism can be adapted to any of a wide range of power requirements, from dry circuitry to high voltage applications, merely by varying the diameters of spring 12 and striker bar 12*a*. Further, the contacts are compact and extremely suitable for miniaturization. Moreover, the contact mechanism exhibits extreme longevity and requires little maintenance. The self wiping nature of the contacts effected between spring 12 and the striker bar substantially reduces or eliminates the necessity for cleaning the contacts, and the unique application of the spring coil to the striker bar causes very little contact wear.

It will be understood that the above description is of a preferred exemplary embodiments of the present invention and that the invention is not limited to the specific form shown. Modifications may be made in the design and arrangement of the elements without departing from the spirit of the invention as expressed in the appended claims.

What is claimed is:

1. A switch comprising:

a first contact comprising generally helical conductive compression spring having at least one coil, said coil being displaced from a predetermined expanded position along a predetermined compression path by compression of said spring;

at least one second contact comprising a resilient conductive transverse members, adapted for flexing in the direction of said compression path, disposed outwardly of said spring and extending inwardly into said compression path in predetermined relation to said coil expanded position, said compression spring providing the sole significant positional bias in respect of said transverse member and said coil; and means for selectively displacing said coil along said compression path to selectively effect a wiping contact between said transverse member and said coil.

2. The switch of claim 1 wherein said transverse member extends into said compression path at a position removed from said coil expanded position by a predetermined distance such that displacement of said coil along said compression path brings said coil into wiping electrical contact with said transverse member whereby said switch provides a normally off operation.

3. The switch of claim 2 wherein said switch includes at least one third contact, comprising a further transverse member.

4. The switch of claim 3 wherein said further transverse member extends into said compression path to electrically contact said coil in said expanded position, flexed by said coil in said expanded position to bias said transverse member against said coil, such that displacement of said coil from said expanded position wipingly removes said coil from electrical contact with said transverse member, whereby said switch provides normally on operation in respect of said third contact.

5. The switch of claim 3 wherein said further transverse member extends into said compression path at a position removed from said coil expanded position by a predetermined distance such that displacement of said coil along said compression path brings said coil into wiping electrical contact with said transverse member whereby said switch provides a normally off operation in respect of said third contact.

6. The switch of claim 1 wherein said transverse member extends into said compression path to electrically contact said coil in said expanded position, said transverse member being flexed by said coil in said expanded position to bias said transverse member against said coil, such that displacement of said coil from said expanded position wipingly removes said coil from electrical contact with said transverse member, whereby said switch provides normally on operation.

7. The switch of claim 1, 2 or 3 wherein said coil defines a nominal interior cylinder and said transverse member extends in a direction tangential to said coil nominal interior cylinder.

8. The switch of claim 1, 2 or 6 wherein said means for selectively displacing said coil comprises a push-button cooperating with said spring.

9. The switch of claim 8 wherein said coil defines a nominal interior cylinder and said transverse member extends in a direction tangential to said coil nominal interior cylinder.

10. The switch of claim 1, 2 or 6 wherein said spring has first and second ends said means for selectively displacing said coil comprises:

means for securing said first end or said spring; and means for selectively displacing a portion of said spring in at least one direction lateral to said compression path, to effect said displacement of said coil along said compression path.

11. The switch of claim 10 wherein said means for selectively displacing said portion of said spring comprises a toggle mechanism.

12. The switch of claim 10 wherein said coil defines a nominal interior cylinder and said transverse member extends in a direction tangential to said coil nominal interior cylinder.

13. The switch of claims 1, 2 or 6 wherein said means for selectively displacing said coil comprises;

a push button;

means for biasing said push button into a steady state;

means responsive to successive depressions of said push button, for alternately effecting displacement of said coil, and releasing said coil into said expanded position.

14. The switch of claim 1 wherein said switch includes a plurality of transverse members.

15. The switch of claim 14 wherein said plurality of transverse members are in different predetermined relations to said coil expanded position.

16. The switch of claim 14 or 15 wherein said coil defines a nominal interior cylinder and at least one of said transverse members extends in a direction tangential to said coil nominal interior cylinder.

17. The switch of claim 16 wherein said coil defines a nominal interior cylinder and each of transverse members extends in a direction tangential to said coil nominal interior cylinder.

18. The switch of claim 1 wherein said spring includes at least first and second coils, and said second contact transverse member extends into the compression path of said first coil, and said switch further includes at least one third contact, said third contact comprising a further resilient conductive transverse member disposed extending into the compression path of said second coil in predetermined relation with said second coil expanded position.

19. The switch of claim 18 wherein said second contact transverse member extends into said compression path at a position removed from said first coil expanded position by a predetermined distance such that displacement of said first coil along said compression path brings said first coil into wiping electrical contact with said transverse member whereby said switch provides a normally off operation in respect of said second contact; and said third contact transverse member extends into said compression path to electrically contact said second coil in said expanded position, said third contact transverse member being flexed by said second coil in said expanded position to bias said transverse member against said second coil, such that displacement of said second coil from said expanded position wipingly removes said second coil from electrical contact with said transverse member, whereby said switch provides normally on operation in respect of said third contact.

20. The switch of claim 18 wherein said second contact transverse member extends into said compression path at a position removed from said first coil expanded position by a predetermined distance such that displacement of said first coil along said compression path brings said first coil into wiping electrical contact with said transverse member whereby said switch provides a normally off operation in respect of said second contact; and said third contact transverse member extends into said compression path at a position removed from said second coil expanded position by a predetermined distance such that displacement of said second coil along said compression path brings said coil into wiping electrical contact with said transverse member whereby said switch provides a normally off operation in respect of said third contact.

21. The switch of claim 20 wherein said second contact predetermined distance is different from said third contact predetermined distance.

22. The switch of claims 18, 19, 20 or 21, wherein said coils define nominal interior cylinders and at least one of said second contact transverse members and third contact transverse member is disposed tangential to the respective nominal interior cylinder of said first and second coils.

23. The switch of claim 1 wherein said compression spring includes a plurality of coils, at least one of said coils comprises an outsized coil having a greater diameter than a coil adjacent thereto in said spring, said transverse member extending inwardly into predetermined relation with said outsized coil.

24. The switch of claim 23 wherein said outsized coil defines a nominal interior cylinder and said transverse member extends in a direction tangential to said nominal cylinder.

25. The switch of claim 23 wherein said means for selectively displacing said coil comprises a push-button cooperating with said spring.

26. The switch of claim 25 wherein said outsized coil defines a nominal interior cylinder and said transverse member extends in a direction tangential to said nominal cylinder.

27. The switch of claim 23 wherein said spring has first and second ends said means for selectively displacing said coil comprises:

means for securing said first end of said spring, and means for selectively displacing a portion of said spring in at least one direction lateral to said compression path, to effect said displacement of said outsized coil along said compression path.

28. The switch of claim 27 wherein said means for selectively displacing said portion of said spring comprises a toggle mechanism.

29. The switch of claim 23 wherein said switch includes a plurality of transverse members.

30. A switch of the type comprising first and second conductive members, and actuation means for selectively effecting an electrical connection between said first and second member, the improvement wherein:

said first conductive member comprises a generally helical compression spring having at least one coil and adapted for compression along a predetermined axis of compression; and said second conductive member comprises a transverse member disposed transverse to said axis of compression, generally tangential to a nominal cylinder concentric with said axis of compression, and in predetermined relation with respect to said spring coil in its expanded state, whereby compression of said spring displaces said coil from said predetermined relation to selectively effect a wiping contact between said coil and said transverse member, said compression spring providing the sole significant positional bias in respect of said transverse member and said coil.

31. The switch of claim 30 wherein said transverse member is disposed removed from said coil in the expanded state of said spring by a predetermined distance in the direction of said axis; and compression of said spring displaces said coil to bring said coil into contact with said transverse member, whereby said switch provides a normally off operation.

32. The switch of claim 31 wherein said compression spring comprises a plurality of coils, and said one coil is of a diameter greater than the diameters of at least one of the coils adjacent thereto in said spring.

33. The switch of claim 30 wherein said transverse member is disposed in electrical contact with said coil when said spring is in an expanded state, and compression of said spring displaces said coil from said transverse member.

34. The switch of claim 33 wherein said compression spring comprises a plurality of coils, and said one coil is of a diameter greater than the diameters of at least one of the coils adjacent thereto in said spring.

35. The switch of claim 30 further comprising at least one additional transverse member disposed transverse to said axis, generally tangential to said nominal cylinder, in predetermined relation with said coil.

36. The switch of claim 30 further comprising an additional transverse member disposed transverse to said axis of compression and generally tangential to a nominal cylinder concentric with the axis of compression of a coil of said spring, at a second predetermined position with respect to said coil.

37. The switch of claim 30 wherein said spring includes at least first and second coils, and said switch further comprises at least one additional transverse member disposed transverse to said axis, generally tangential to said nominal cylinder, in predetermined relation with said second coil with said spring in an expanded state.

38. The switch of claim 37 wherein said additional transverse member predetermined relation with said second coil is different from the predetermined relation of said first mentioned transvere member with said first coil.

39. The switch of claim 30 wherein said compression spring includes a plurality of coils, at least one of said coils comprises an outsized coil having a greater diameter than a coil adjacent thereto in said spring, said transverse member disposed in predetermined relation with said outsized coil.

40. The switch of claim 30 wherein said compression spring comprises a plurality of coils, and said one coil is of a diameter greater than the diameters of at least one of the coils adjacent thereto in said spring.

* * * * *